United States Patent [19]

Toler

[11] 4,044,499

[45] Aug. 30, 1977

[54] WHIRL TOY

[76] Inventor: Jacob A. Toler, 4900 Pembridge Ave., Baltimore, Md. 21215

[21] Appl. No.: 672,418

[22] Filed: Mar. 31, 1976

[51] Int. Cl.[2] ..... A63H 1/32; A63H 33/26

[52] U.S. Cl. ..... 46/228; 46/51

[58] Field of Search ..... 46/47, 51, 52, 228; 240/6 R, 31

[56] References Cited

U.S. PATENT DOCUMENTS

| | | | |
|---|---|---|---|
| 2,217,111 | 10/1940 | Gould | 46/51 |
| 3,011,048 | 11/1961 | O'Brien | 46/228 |
| 3,971,158 | 7/1976 | Hanson | 46/228 |

*Primary Examiner*—Louis G. Mancene
*Assistant Examiner*—Robert F. Cutting
*Attorney, Agent, or Firm*—J. Wesley Everett

[57] ABSTRACT

The whirl toy is formed of an elongated flat body member having a portion cut away substantially equi-distant from its lateral edges into which is mounted a battery operated light assembly having means for lighting the light when the toy is whirled about in a circular path and to extinguish the light when the whirling ceases.

4 Claims, 5 Drawing Figures

WHIRL TOY

The present invention relates to a toy of the type whirled about in a circular path on the end of a suitable thong or string-like flexible member.

One object of the invention is to provide a whirl toy having a unique lighting arrangement.

Another object of the invention is to provide a new and novel means for attaching a battery and light element to the toy.

A further object of the invention is to provide an improved means for switching the light on or off.

While several objects of the invention have been set forth, other objects of the invention will become obvious as the nature of the invention is more fully disclosed from the following detailed description and the accompanying drawings, in which.

In referring to the drawings, like reference characters are used to point out like and similar parts throughout the several views.

Figure 1:
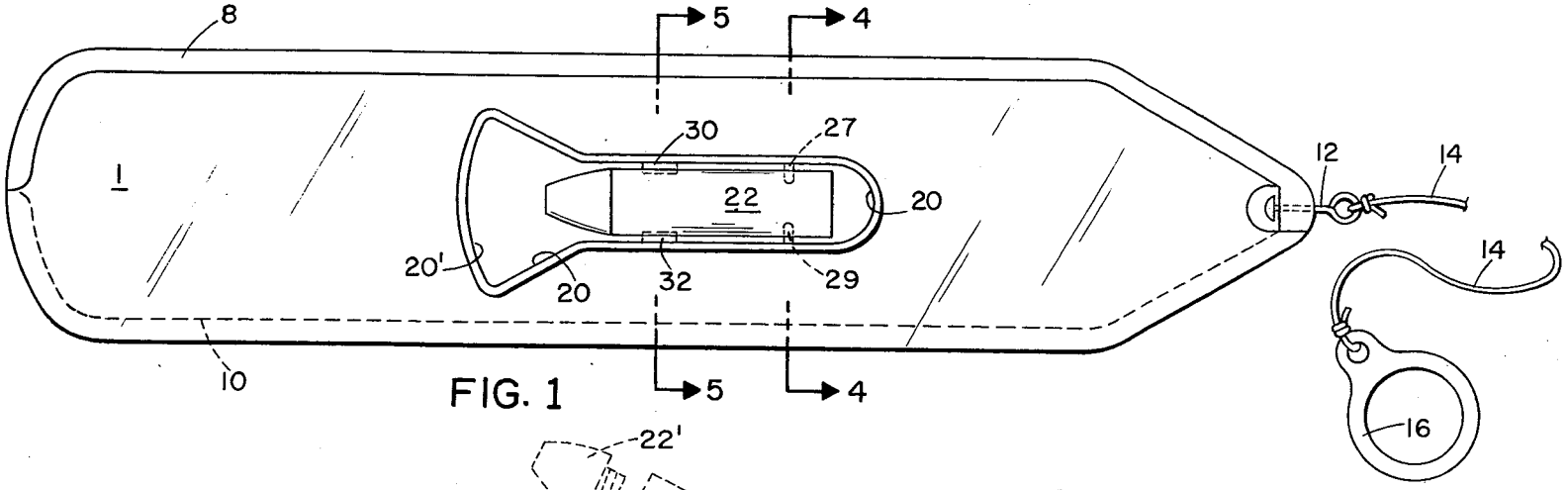
FIG. 1 is a side elevational view of the toy.

The toy comprises a flat body portion 1 having a bead extending completely around the edge of the body portion. On one half of the body portion the bead portion 8 extends outwardly along the edge thereof from one side of the outer surface of the body portion, and on the opposite edge of the body portion the bead 10 extends outwardly from the surface of the opposite side of the body member, the object of these oppositely placed beads is to cause the body to turn on its longitudinal axes as the toy is being whirled about. While the toy is shown molded from a plastic material, it may be made fron any suitable material.

One end of the body portion 1 is provided with a connector means 12 to which is attached one end of a thong or string 14 and a ring 16 at its opposite end for slipping over the finger when the tov is being whirled about. While the connector means is shown as a swivel, it may be in the form of a small opening in the end of the body portion itself (not shown).

Centered substantially midway between the lateral edges of the body portion there is provided an aperture 20. While this aperture 20 is shown substantially in the longitudinal center of the body portion 1, it may be conveniently located at any suitable place along the longitudinal axis of the said body portion.

Pivotally mounted within the aperture 20 is a casing 22 for housing the battery 24 and the light element 26. The housing 22 is pivotally secured to the body portion 1 by the pins 27 and 29 in any conventional manner. The pins are positioned at the end of casing nearest the end of the body portion to which the thong or string 14 is attached. The opposite end of the housing is held in alignment with the axis of the body member preferably by small elastic extensions 30 and 32 adapted to engage the recesses 34 and 36, carried by the housing 22.

Figure 2:
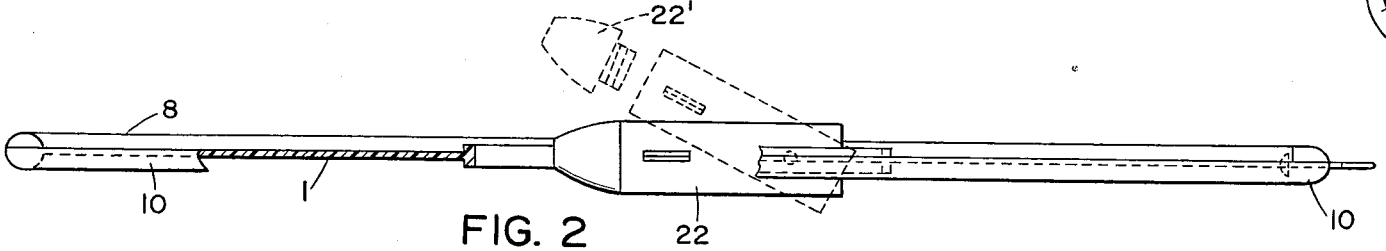
FIG. 2 is an edge view in elevation of the toy.
Figure 4:
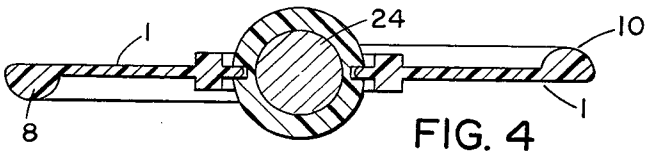
FIG. 4 is an enlarged sectional view taken on line 4—4 of FIG. 1.
Figure 5:
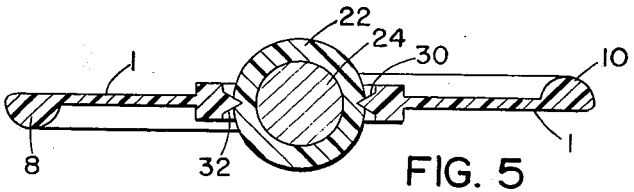
FIG. 5 is an enlarged sectional view taken on line 5—5 of FIG. 1.

This arrangement provides for the casing 22 to be released from the elastic extensions 30 and 32 and swung to one side of the body member where the transparent cap end 22' of the housing may be removed to replace the battery and the lamp element 26, as shown best in FIG. 2.

The object of locating the lamp 26 centrally of the body member is that the light will shine on both surfaces of the body member when lighted. Of course if desired, more than one light element could be substituted for the one light element shown.

Figure 3:
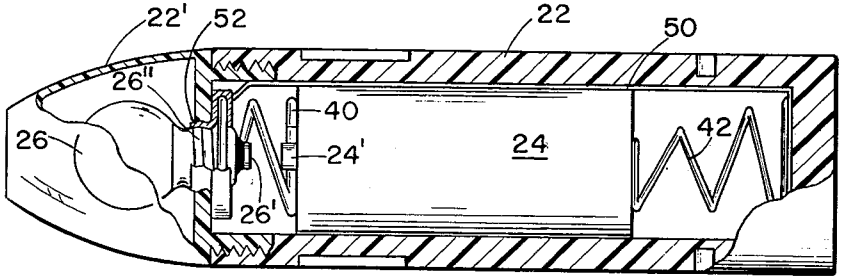
FIG. 3 is an enlarged sectional view of the light assembly.

Referring again to the lighting assembly, the battery 24 is suspended in the casing 22 as shown in FIG. 3 by two compression springs 40 and 42, the spring 40 is the stronger of the two and when at rest will keep the positive pole 24' of the battery out of contact with the center contact 26' of the light or bulb 26. The weaker spring 42 is always in contact with the opposite end of the battery to make the negative contact and connecting the same to the other light terminal 26'' by means of the members 50 and 52.

While the battery is shown suspended between spring members 40 and 42, these resilient members may take other forms such as rubber or elastic bands, or other means such as a switch which may be employed for connecting the lamp bulb to the battery electric circuit by centrifugal force.

The opposite sides of the body member may be of varied contrasting colors so that when the body member is whirled and at the same time rotated about its longitudinal axis, it will flash different colors. Also the light bulb itself or the transparent end 22' of the housing may be of a different color to flash different color lights as the toy spins about its longitudinal axis.

It is understood that the toy may be made of any suitable material.

In operation the light assembly is readied as previously described. One end of a suitable length string is secured to the swivel 12 and the opposite end secured to the ring 16 and the toy is ready for use. As the toy is whirled about, centrifugal force moves the battery outwardly until the pole 24' of the battery comes in contact with the contact 26' of the light element lighting the element, which is a light bulb, directing its light toward the end 20' of the aperture 20 in the body portion and will, therefore, be visible from either side of the body portion, and at the same time light each side of the outer end of the body portion. When the whirling action stops, the spring 40 moves the battery out of contact with the lamp terminal 26' so that no current from the battery will be used when the toy is at rest.

While one form of the invention has been shown and described it is not intended as a limitation as the scope of the invention is best defined in the appended claims.

I claim:

1. An improved whirl toy including an elongated, thin, substantially flat body member having circular side surfaces and parallel edges and means at one end thereof for attaching a thong thereto for whirling the body member in a circular path, the improvement comprising:

a. said body member having an opening extending therethrough adjacent the center;

b. a light assembly fitted centrally of said opening including a casing of such dimensions as to house a battery and a light element;

c. said casing being hingedly supported within the opening at a point adjacent the rear end of the casing, the center of the casing being in a plane with the elongated axis of the body;

d. means at the opposite ends of the casing for releasably securing the casing to the opposite end of said opening;

d. a battery having means for electrically connecting the light element with the battery when the toy is put in a whirling circular path.

2. A whirl toy as claimed in claim 1 wherein there is provided a bead adjacent each elongated circular side edge, one of said beads being positioned along one side surface of the body member and the other bead member being positioned along the opposite surface of the said body member.

3. A whirl toy as claimed in claim 1 wherein the casing is provided with means within the said casing for connecting the battery with the light element when the toy is whirled about a circular path by the thong, and disconnecting the battery from the light element when the whirling action has ceased.

4. A whirl toy as claimed in claim 3 wherein the means for connecting and disconnecting the light element with the battery is in the form of one or more spring elements of predetermined resistance.

* * * * *